US010398231B1

(12) United States Patent
Musanti

(10) Patent No.: US 10,398,231 B1
(45) Date of Patent: Sep. 3, 2019

(54) LOUNGE CHAIR

(71) Applicant: Linda Musanti, Manalapan, NJ (US)

(72) Inventor: Linda Musanti, Manalapan, NJ (US)

( * ) Notice: Subject to any disclaimer, the term of this patent is extended or adjusted under 35 U.S.C. 154(b) by 568 days.

(21) Appl. No.: 15/187,864

(22) Filed: Jun. 21, 2016

(51) Int. Cl.
*A47C 1/14* (2006.01)
*A47C 3/40* (2006.01)

(52) U.S. Cl.
CPC ..... *A47C 3/40* (2013.01); *A47C 1/14* (2013.01); *A47C 1/143* (2013.01)

(58) Field of Classification Search
CPC ..... A47C 3/40; A47C 1/14; A47C 1/143
USPC ..... 297/344.18
See application file for complete search history.

(56) References Cited

U.S. PATENT DOCUMENTS

| | | | | |
|---|---|---|---|---|
| D280,276 | S | 8/1985 | McKay | |
| 5,246,265 | A | 9/1993 | Nagan | |
| D356,899 | S | 4/1995 | Vasconcellos | |
| 5,494,333 | A | 2/1996 | Wilson | |
| 6,095,607 | A | 8/2000 | Wenzel | |
| 6,213,555 | B1 | 4/2001 | Sulpizio | |
| 7,631,940 | B1 | 12/2009 | Jager | |
| 8,459,741 | B2 | 6/2013 | Mazzola | |
| 8,794,699 | B1 * | 8/2014 | Rudolfo | A47C 4/20 297/344.18 X |
| 9,039,077 | B1 * | 5/2015 | Santamaria | A47C 1/146 297/344.18 |
| 2007/0236057 | A1 | 10/2007 | Smith | |
| 2008/0179933 | A1 | 7/2008 | Puccio | |

FOREIGN PATENT DOCUMENTS

| | | | |
|---|---|---|---|
| WO | 2006021780 | A2 | 3/2006 |

* cited by examiner

*Primary Examiner* — Anthony D Barfield

(57) ABSTRACT

The improved lounge chair is an item of furniture that is adapted for use by a person. Specifically, the improved lounge chair has a vertical height adjustment that allows the vertical height of the improved lounge chair to be adjusted by a person. The improved lounge chair further comprises other improvements that improve the stability of the improved lounge chair for the person of limited mobility. The improved lounge chair comprises a plurality of panels and a support system.

12 Claims, 5 Drawing Sheets

LOUNGE CHAIR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of domestic articles and chairs, more specifically, a beach chair characterized by structural features.

Lounge and beach chairs are fixtures at outdoor locations and events because they are practical, comfortable and easy to transport. However, their usefulness declines for people with limitations in their mobility because they can be difficult to get into and out of. Two of the major difficulties with lounge and beach chairs are that: 1) lounge and beach chairs tend to be low to the ground which can be problematic for people with limitations in their mobility; and, 2) lounge and beach chairs tend to be too unstable for safe use by people with limitations in their mobility. This problem is inherent with lounge and beach chairs in the sense that smaller legs creates a smaller form factor which makes lounge and beach chairs easier to transport. However, this smaller form factor comes at the expense of vertical height and stability of the lounge and beach chair.

Clearly, a lounge and beach chair a readily transportable lounge and beach chairs that meets the unmet needs of people with limited mobility would be desirable.

SUMMARY OF INVENTION

The improved lounge chair is an item of furniture that is adapted for use by a person of limited mobility. Specifically, the improved lounge chair has a vertical height adjustment that allows the vertical height of the improved lounge chair to be adjusted by a person of limited mobility. The improved lounge chair further comprises other improvements that improve the stability of the improved lounge chair for the person of limited mobility.

These together with additional objects, features and advantages of the improved lounge chair will be readily apparent to those of ordinary skill in the art upon reading the following detailed description of the presently preferred, but nonetheless illustrative, embodiments when taken in conjunction with the accompanying drawings.

In this respect, before explaining the current embodiments of the improved lounge chair in detail, it is to be understood that the improved lounge chair is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the improved lounge chair.

It is therefore important that the claims be regarded as including such equivalent construction insofar as they do not depart from the spirit and scope of the improved lounge chair. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
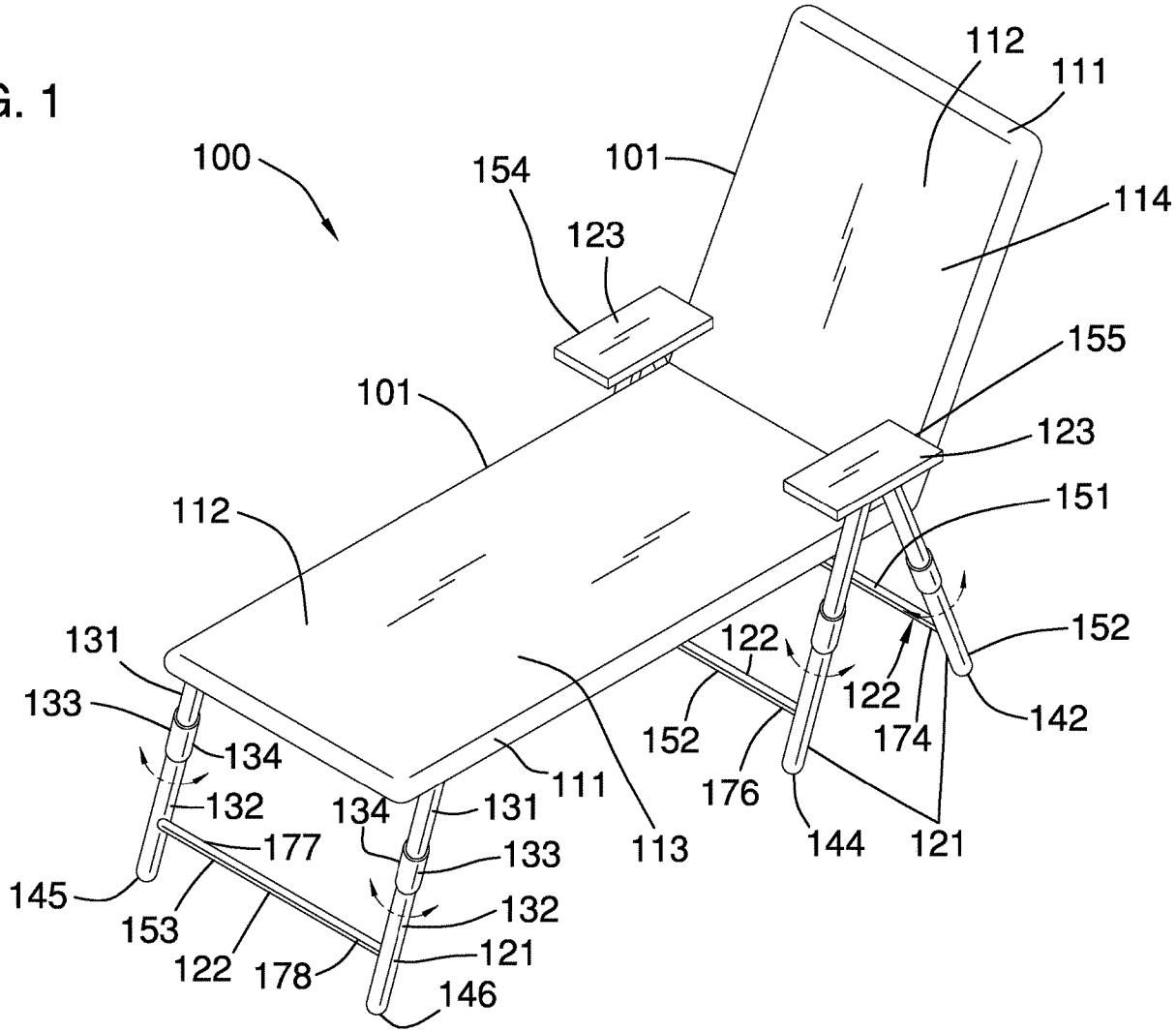
FIG. 1 is a perspective view of an embodiment of the disclosure.
Figure 2:
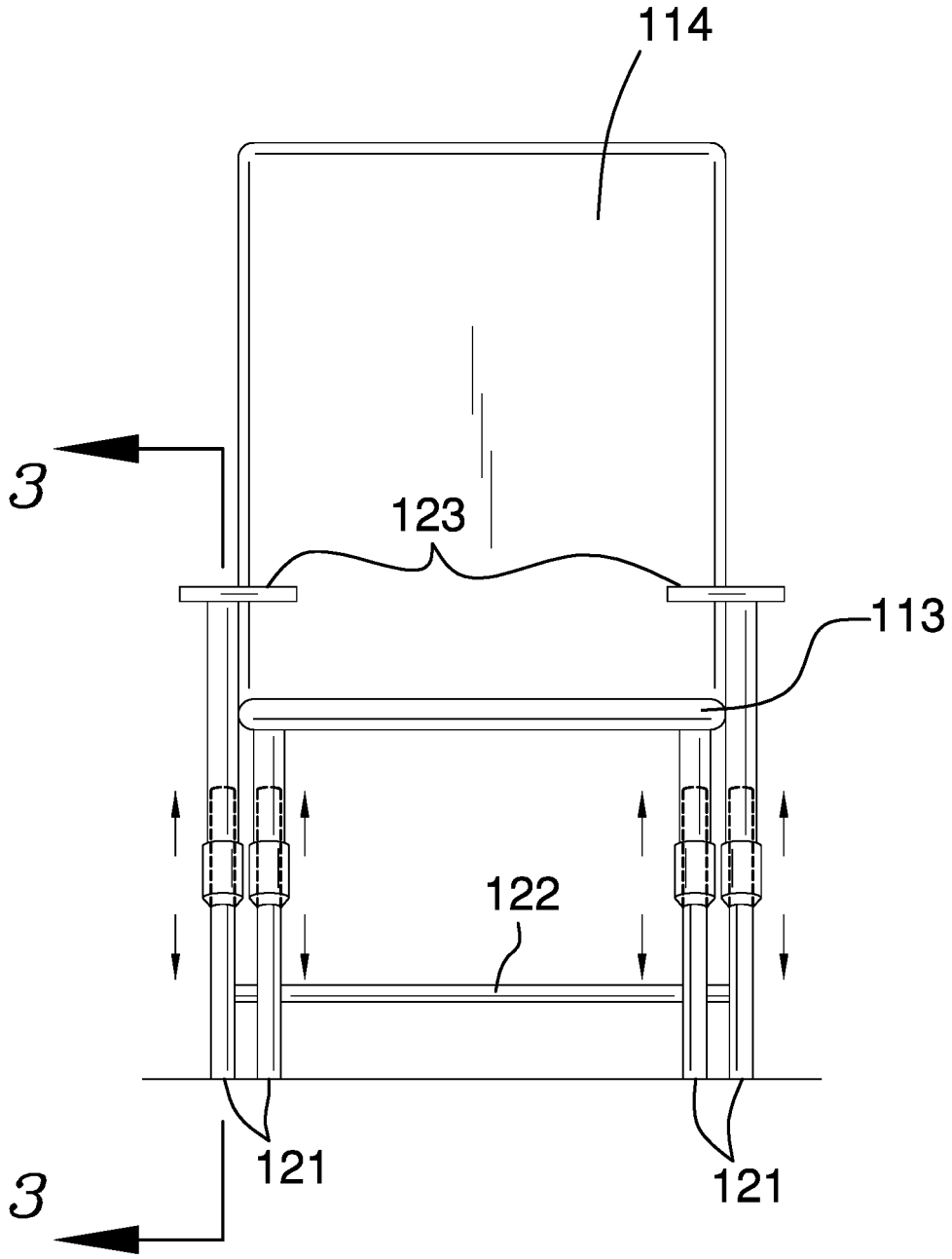
FIG. 2 is a front view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The improved lounge chair 100 (hereinafter invention) comprises a plurality of panels 101 and a support system 102. The invention 100 is an item of furniture that is adapted for use by a person of limited mobility. Specifically, the invention 100 has a vertical height 191 adjustment that allows the vertical height 191 of the invention 100 to be adjusted by the person of limited mobility. The invention 100 further comprises other improvements that enhance the stability of the invention 100 for the person of limited mobility.

The plurality of panels 101 are the surfaces of the invention 100 upon which a person will rest. Each of the plurality of panels 101 comprises a rail 111 and a stretcher 112. The rail 111 is an open rectangular frame that can be formed from metal, wood, or plastic. The stretcher 112 is a rectangular textile that is attached to the rail 111. The stretcher 112 is attached to the rail 111 under tension such that the stretcher 112 will support the weight of a person (assumed minimum 30 kg) resting upon any panel selected from the plurality of panels 101. Methods to attach stretchers 112 to rails 111 are well known and documented in the textile arts and in the furniture arts.

The plurality of panels 101 further comprises a seat panel 113 and a back panel 114. The seat panel 113 and the back panel 114 are attached to each other using commercially available hardware. The seat panel 113 and the back panel 114 are attached such that the seat panel 113 is parallel to the supporting surface 193. The seat panel 113 and the back panel 114 are attached to form a relative angle 192 that allows a person to sit in a partially reclined position. It is preferred that the relative angle 192 between the seat panel 113 and the back panel 114 be adjustable. The devices and methods necessary to attach the seat panel 113 to the back panel 114 in the manner described in this paragraph are well known and documented in the furniture arts.

The plurality of panels 101 are raised by the support system 102 to a vertical height 191 above the supporting surface 193 by the support system 102. The support system 102 comprises a plurality of legs 121, a plurality of cross braces 122, and a plurality of manchettes 123.

Each of the plurality of legs 121 is a supporting structure that can be varied in length. Each of the plurality of legs 121 further comprises an upper support 131, a lower support 132, a telescopic tube locking assembly 133, and a twist tube 134. The upper support 131 is a first cylindrical tube. The lower support 132 is a second cylindrical tube. The first inner diameter and the first outer diameter of the upper support 131 and the second inner diameter and the second outer diameter of the lower support 132 are selected such that the upper support 131 and the lower support 132 can be joined in a telescopic manner. The upper support 131 and the lower support 132 are joined with a telescopic tube locking assembly 133. Telescopic tube locking assemblies 133 are commonly and commercially available. Suitable telescopic tube locking assemblies 133 include, but are not limited to, threaded clutches, G snap collars, or internal cam twist lock mechanisms 135. The internal cam twist lock mechanism 135 is preferred and is used in the first potential embodiment of the disclosure.

Figure 3:
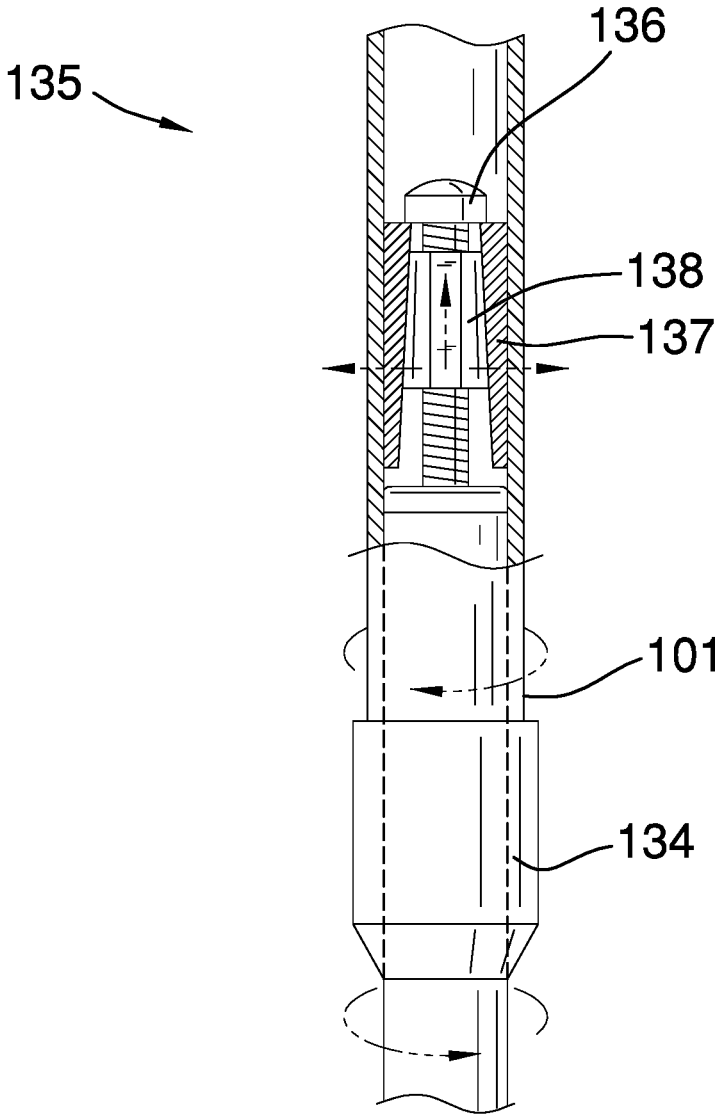
FIG. 3 is a cross-sectional view of an embodiment of the disclosure across 3-3 as shown in FIG. 2.

As shown most clearly in FIG. 3, the internal cam twist lock mechanism 135 is a friction based locking device. The internal cam twist lock mechanism 135 comprises a screw 136, a cam 137, and the frustum of a cone 138. The frustum of the cone 138 is screwed onto the screw 136 and the screw 136 is attached to and extremity of a support that is selected from the group consisting of the upper support 131 or the lower support 132. The support is selected such that the support selected from the group will be inserted into the remaining support. The remaining support has inserted in it the cam 137. The theory of operation is that the screw 136 and the frustum of the cone 138 are inserted into the remaining support such that the screw 136 and the frustum of the cone 138 are within the center of the cam 137.

As the internal cam twist lock mechanism 135 is rotated around the center axis of the support, the position of the frustum of the cone 138 changes relative to the cam 137 which changes the frictional forces between the frustum of the cone 138 and the cam 137 thereby locking the position of the selected support relative to the remaining support relative position of the selected support. Alternately, rotating the selected support in the opposite direction will loosen the connection thus allowing the position of the internal cam twist lock mechanism 135 relative to the remaining support relative position of the selected support to be changed. In the first potential embodiment of the disclosure, a twist tube 134 is added to each leg selected from the plurality of legs 121.

In the first potential embodiment of the disclosure, each leg selected from the plurality of legs 121 further comprises a twist tube 134. The twist tube 134 performs the role of both a lever and a grip in the operation of the internal cam twist lock mechanism 135.

Each of the plurality of cross braces 122 is a shaft that interconnects two legs selected from the plurality of legs 121. The purpose of each of the plurality of cross braces 122 is to provide stability to the invention 100.

Each of the plurality of manchettes 123 is a plate that in normal use acts as an arm rest for the invention 100. However, each of the plurality of manchettes 123 is attached to and supported by two legs selected from the plurality of legs 121. The purpose of using two legs selected from the plurality of legs 121 to support each manchette selected from the plurality of manchettes 123 is to allow a person of limited mobility to put their full weight on any manchette selected from the plurality of manchettes 123 in order to more easily get into and out of the invention 100.

The plurality of legs 121 further comprises a first leg 141, a second leg 142, a third leg 143, a fourth leg 144, a fifth leg 145, and a sixth leg 146. The first leg 141 is further defined with a first end 161 and a second end 162. The second leg 142 is further defined with a third end 163 and a fourth end 164. The third leg 143 is further defined with a fifth end 165 and a sixth end 166. The fourth leg 144 is further defined with a seventh end 167 and an eighth end 168. The fifth leg 145 is further defined with a ninth end 169 and a tenth end 170. The sixth leg 146 is further defined with an eleventh end 171 and a twelfth end 172.

The plurality of cross braces 122 further comprises a first cross brace 151, a second cross brace 152, and a third cross brace 153. The first cross brace 151 is further defined with a thirteenth end 173 and a fourteenth end 174. The second cross brace 152 is further defined with a fifteenth end 175 and a sixteenth end 176. The third cross brace 153 is further defined with a seventeenth end 177 and an eighteenth end 178.

The plurality of manchettes 123 further comprises a first manchette 154 and a second manchette 155. The first manchette 154 is further defined with a first surface 181 and a second surface 182. The second manchette 155 is further defined with a third surface 183 and a fourth surface 184.

Figure 4:
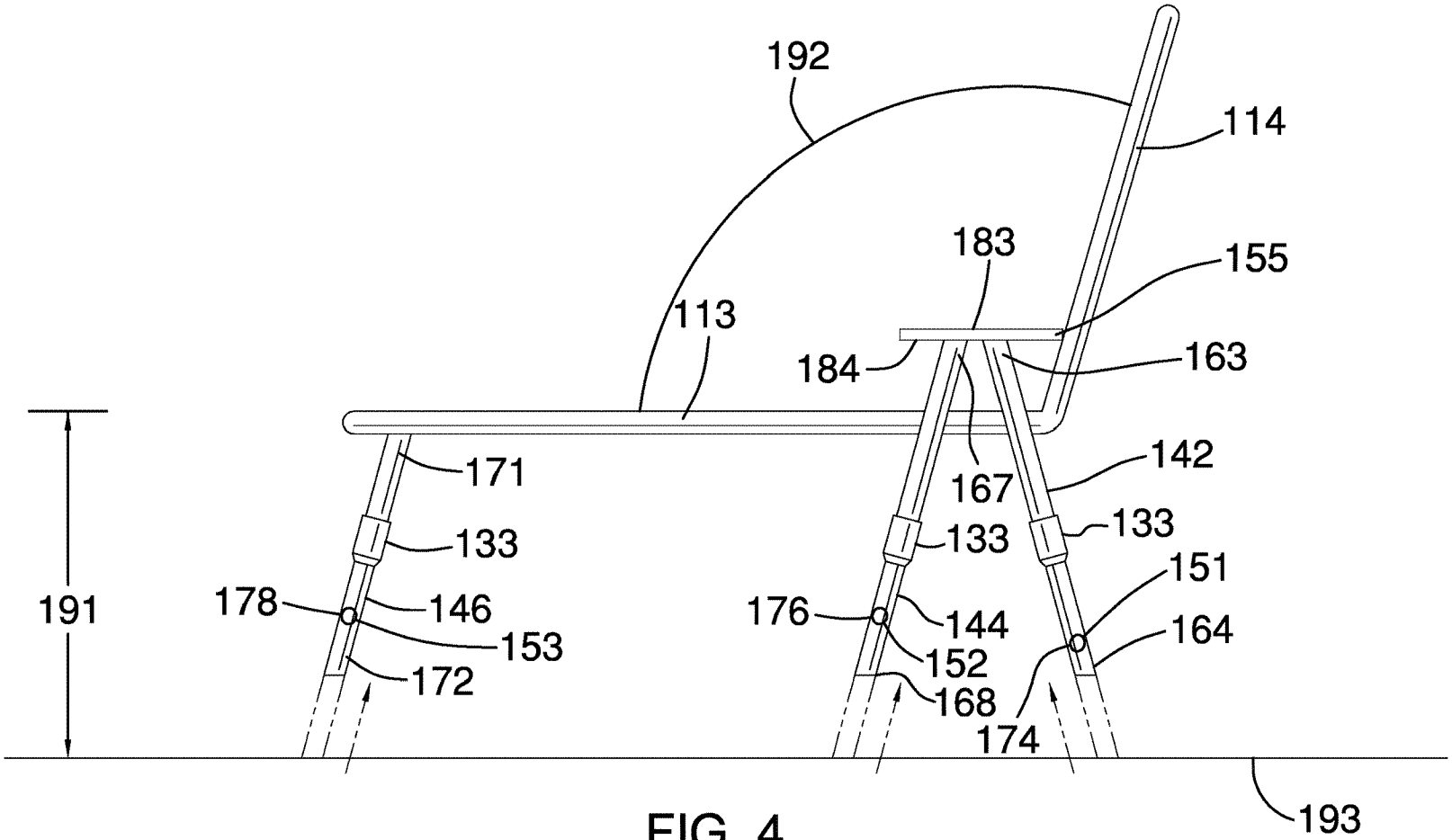
FIG. 4 is a side view of an embodiment of the disclosure.
Figure 5:
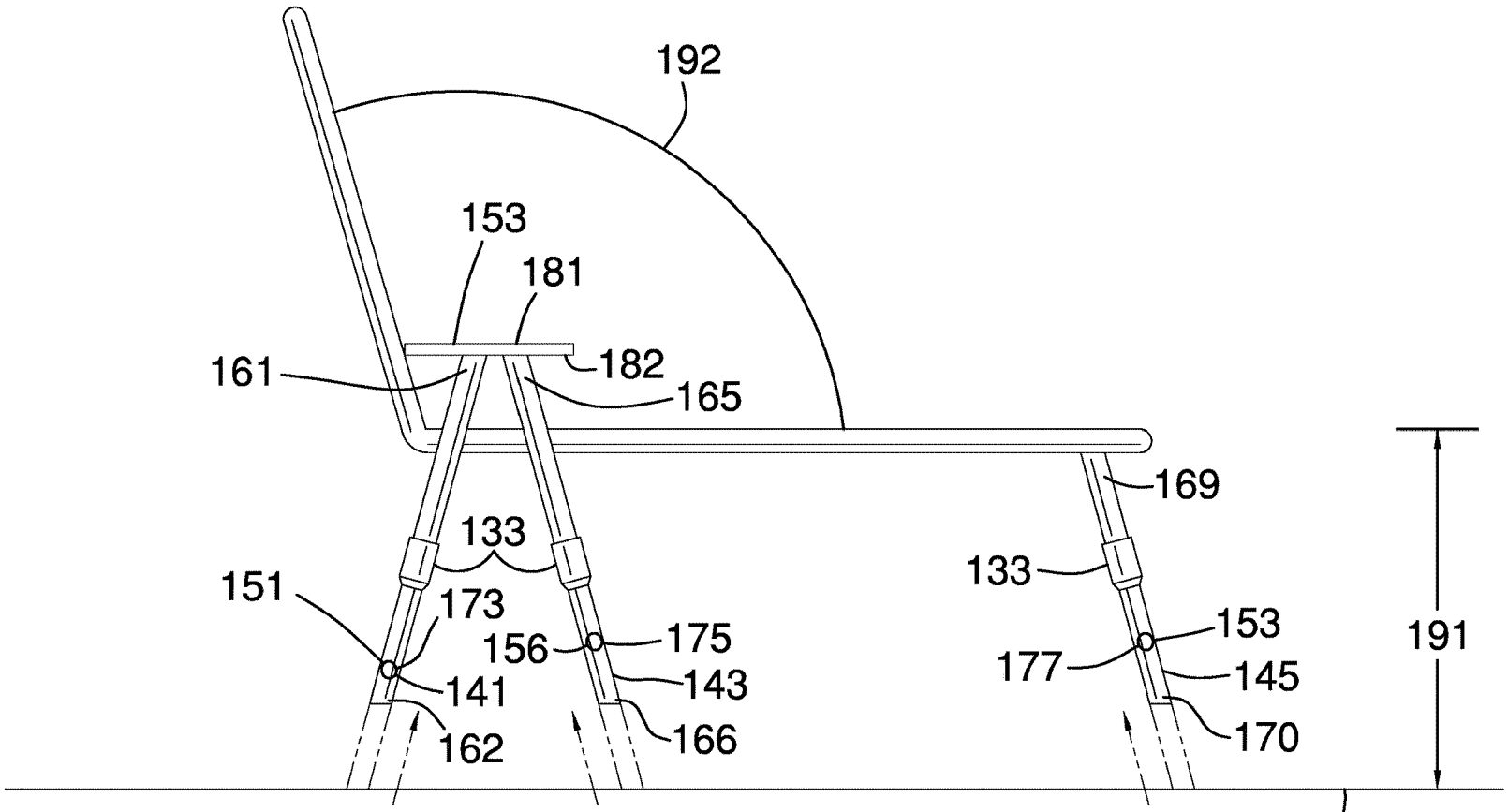
FIG. 5 is a reverse side view of an embodiment of the disclosure.

As shown most clearly in FIGS. 1, 4, and 5, the invention 100 is assembled as follows.

The first end 161 of the first leg 141 attaches to the second surface 182 of the first manchette 154. The third end 163 of the second leg 142 attaches to the fourth surface 184 of the second manchette 155. The fifth end 165 of the third leg 143 attaches to the second surface 182 of the first manchette 154. The seventh end 167 of the fourth leg 144 attaches to the fourth surface 184 of the second manchette 155. The ninth end 169 of the fifth leg 145 attaches in a rotatable manner to the rail 111 of the seat panel 113. The eleventh end 171 of the sixth leg 146 attaches in a rotatable manner to the rail 111 of the seat panel 113. The cylinder surface of the first leg 141 attaches in a rotatable manner to the rail 111 of the seat panel 113. The cylinder surface of the second leg 142 attaches in a rotatable manner to the rail 111 of the seat panel 113. The cylinder surface of the third leg 143 attaches in a rotatable manner to the rail 111 of the seat panel 113. The cylinder surface of the fourth leg 144 attaches in a rotatable manner to the rail 111 of the seat panel 113. These rotatable attachments are made with a commercially available pivot. The purpose of the rotatable attachments is to allow the invention 100 to be collapsed for transport. Methods to attach objects in a rotatable and collapsible manner are well known and documented in the mechanical arts.

The thirteenth end 173 of the first cross brace 151 attaches to the cylinder surface of the first leg 141. The fourteenth end 174 of the first cross brace 151 attaches to the cylinder surface of the second leg 142. The fifteenth end 175 of the second cross brace 152 attaches to the cylinder surface of the third leg 143. The sixteenth end 176 of the second cross brace 152 attaches to the cylinder surface of the fourth leg 144. The seventeenth end 177 of the third cross brace 153 attaches to the cylinder surface of the fifth leg 145. The eighteenth end 178 of the third cross brace 153 attaches to the cylinder surface of the sixth leg 146.

In the first potential embodiment of the disclosure, the rails 111, legs, and cross braces are made of aluminum tubing. The manchettes are made of aluminum plate. Of note in the design of the first potential embodiment of the disclosure, is that it is preferred and highly recommended that the aluminum selected for use be of a heavier stock grade than would normally selected for this type of application in order to increase the stability of the structure.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Cone: As used in this disclosure, a cone is a surface that is generated by rotating a triangle around one of the legs of the triangle. If a line that is perpendicular to the base that is drawn from the center of the base goes through the vertex of the triangle then the cone is called a right cone.

Cylinder: As used in this disclosure, a cylinder is a geometric structure defined by two identical flat and parallel ends, also commonly referred to as bases, which are circular in shape and connected with a single curved surface wherein when the cross section of the cylinder remains the same from one end to another. The axis of the cylinder is formed by the straight line that connects the center of each of the two identical flat and parallel ends of the cylinder. In this disclosure, the term cylinder specifically means a right cylinder which is defined as a cylinder wherein the curved surface perpendicularly intersects with the two identical flat and parallel ends.

Diameter: As used in this disclosure, a diameter of an object is a straight line segment that passes through the center of an object. The line segment of the diameter is terminated at the perimeter or boundary of the object through which the line segment of the diameter runs.

Form Factor: As used in this disclosure, the term form factor refers to the size and shape of an object.

Frustum: As used in this disclosure, a frustum is a portion of a solid that lies between two parallel planes that intersect with the solid.

Inner Diameter: As used in this disclosure, the term inner diameter is used in the same way that a plumber would refer to the inner diameter of a pipe.

Outer Diameter: As used in this disclosure, the term outer diameter is used in the same way that a plumber would refer to the outer diameter of a pipe.

Pivot: As used in this disclosure, a pivot is a rod or shaft around which an object rotates or swings.

Telescopic: As used in this disclosure, telescopic is an adjective that describes an object made of sections that fit or slide into each other such that the object can be made longer or shorter by adjusting the relative positions of the sections.

Textile: As used in this disclosure, a textile is a material that is woven, knitted, braided or felted. Synonyms in common usage for this definition include fabric and cloth.

Tube: As used in this disclosure, a tube is a hollow cylindrical device that is used for transporting liquids and gasses. The line that connects the center of the first base of the cylinder to the center of the second base of the cylinder is referred to as the axis of the cylinder or the centerline of the tube.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A domestic article comprising:

a plurality of panels and a support system;

wherein the domestic article is an item of furniture;

wherein the item of furniture is selected from the group consisting of a beach chair or a lounge chair;

wherein the domestic article has a vertical height above the supporting surface;

wherein the vertical height is adjustable;

wherein each of the plurality of panels comprises a rail and a stretcher;

wherein the stretcher is attached under tension to the rail;

wherein the rail is an open rectangular frame;

wherein the plurality of panels further comprises a seat panel and a back panel;

wherein the seat panel and the back panel are attached to each other;

wherein the seat panel and the back panel are positioned such that the seat panel is parallel to the supporting surface;

wherein the seat panel and the back panel are attached to form a relative angle;

wherein the vertical height of the plurality of panels is adjusted through a support system;

wherein the support system comprises a plurality of legs, a plurality of cross braces, and a plurality of manchettes;

wherein each of the plurality of legs is attached to a cross brace selected from the plurality of cross braces;

wherein each of the plurality of manchettes is attached to one or more legs selected from the plurality of legs;

wherein each leg selected from the plurality of legs is adjustable in length;

wherein each of the plurality of legs comprises an upper support and a lower support, wherein the upper support is a first cylindrical tube;

wherein the lower support is a second cylindrical tube;

wherein the upper support and the lower support are joined in a telescopic manner;

wherein each of the plurality of legs further a telescopic tube locking assembly, and a twist tube;

wherein the upper support and the lower support are joined with a telescopic tube locking assembly.

2. The domestic article according to claim 1 wherein the telescopic tube locking assembly is selected from the group consisting of a threaded clutches, a G snap collar, or an internal cam twist lock mechanisms.

3. The domestic article according to claim 2 wherein each of the plurality of cross braces is a shaft that interconnects two selected from the plurality of legs;

wherein each of the plurality of manchettes is a plate.

4. The domestic article according to claim 3 wherein the plurality of legs further comprises a first leg, a second leg, a third leg, a fourth leg, a fifth leg, and a sixth leg;

wherein the first leg is further defined with a first end and a second end;

wherein the second leg is further defined with a third end and a fourth end;

wherein the third leg is further defined with a fifth end and a sixth end;

wherein the fourth leg is further defined with a seventh end and an eighth end;

wherein the fifth leg is further defined with a ninth end and a tenth end;

wherein the sixth leg is further defined with an eleventh end and a twelfth end.

5. The domestic article according to claim 4 wherein the plurality of cross braces further comprises a first cross brace, a second cross brace, and a third cross brace;

wherein the first cross brace is further defined with a thirteenth end and a fourteenth end;

wherein the second cross brace is further defined with a fifteenth end and a sixteenth end;

wherein the third cross brace is further defined with a seventeenth end and an eighteenth end.

6. The domestic article according to claim 5 wherein the plurality of manchettes further comprises a first manchette and a second manchette;

wherein the first manchette is further defined with a first surface and a second surface;

wherein the second manchette is further defined with a third surface and a fourth surface.

7. The domestic article according to claim 6 wherein the first end of the first leg attaches to the second surface of the first manchette;

wherein the third end of the second leg attaches to the fourth surface of the second manchette;

wherein the fifth end of the third leg attaches to the second surface of the first manchette;

wherein the seventh end of the fourth leg attaches to the fourth surface of the second manchette.

8. The domestic article according to claim 7 wherein the cylinder surface of the first leg attaches in a rotatable manner to the rail of the seat panel;

wherein the cylinder surface of the second leg attaches in a rotatable manner to the rail of the seat panel;

wherein the cylinder surface of the third leg attaches in a rotatable manner to the rail of the seat panel;

wherein the cylinder surface of the fourth leg attaches in a rotatable manner to the rail of the seat panel.

9. The domestic article according to claim 8 wherein the ninth end of the fifth leg attaches in a rotatable manner to the rail of the seat panel;

wherein the eleventh end of the sixth leg attaches in a rotatable manner to the rail of the seat panel.

10. The domestic article according to claim 9 wherein the thirteenth end of the first cross brace attaches to the cylinder surface of the first leg;

wherein the fourteenth end of the first cross brace attaches to the cylinder surface of the second leg;

wherein the fifteenth end of the second cross brace attaches to the cylinder surface of the third leg;

wherein the sixteenth end of the second cross brace attaches to the cylinder surface of the fourth leg;

wherein the seventeenth end of the third cross brace attaches to the cylinder surface of the fifth leg;

wherein the eighteenth end of the third cross brace attaches to the cylinder surface of the sixth leg.

11. The domestic article according to claim 10 wherein the relative angle is adjustable.

12. The domestic article according to claim 11 wherein the telescopic tube locking assembly is an internal cam twist lock mechanisms.

* * * * *